US006120122A

United States Patent [19]

Takemoto et al.

[11] Patent Number: 6,120,122

[45] Date of Patent: Sep. 19, 2000

[54] INKJET RECORDING APPARATUS

[75] Inventors: Hitoshi Takemoto; Tadashi Mizoguchi; Junichi Suetsugu; Hitoshi Minemoto; Kazuo Shima; Yoshihiro Hagiwara; Toru Yakushiji, all of Niigata, Japan

[73] Assignee: NEC Corporation, Japan

[21] Appl. No.: 08/972,619

[22] Filed: Nov. 18, 1997

[30] Foreign Application Priority Data

Nov. 19, 1996 [JP] Japan ..... 8-308083
Dec. 2, 1996 [JP] Japan ..... 8-321892

[51] Int. Cl.[7] ..... B41J 29/38; B41J 2/06

[52] U.S. Cl. ..... 347/13; 347/55

[58] Field of Search ..... 347/9–15, 55, 347/145, 180, 182

[56] References Cited

U.S. PATENT DOCUMENTS 5,818,473 10/1998 Fuji et al. ..... 347/11
5,877,790 3/1999 Hagiwara et al. ..... 347/55

FOREIGN PATENT DOCUMENTS 93 11866 6/1993 WIPO .

*Primary Examiner*—John Barlow
*Assistant Examiner*—Craig A. Hallacher
*Attorney, Agent, or Firm*—Ostrolenk, Faber, Gerb, & Soffen, LLP

[57] ABSTRACT

An inkjet recording apparatus includes K ejection electrodes and K gate electrodes corresponding to the K ejection electrodes, respectively, which are located at a distance from the K ejection electrodes. The K gate electrodes are divided into M blocks each having N gate electrodes electrically connected in common. A first voltage pulse is applied to a selected one of N groups each formed by electrically connecting an $i^{th}$ ($1 \leqq i \leqq N$) ejection electrode for each block to each other and a second voltage pulse is applied to a selected one of the M blocks. A voltage difference is generated between a group and a block which are selected from the N groups and the M blocks depending on an input signal, wherein the voltage difference is equal to or greater than a minimum voltage difference which causes ejection of an ejection electrode.

32 Claims, 7 Drawing Sheets

INKJET RECORDING APPARATUS

BACKGROUND OF THE INVENTION

1. Field of the Invention

The present invention relates to an inkjet recording apparatus which is capable of ejecting particulate matter such as pigment matter and toner matter by making use of an electric field, and more particularly to control for the inkjet recording apparatus.

2. Description of the Related Art

There has recently been a growing interest in non-impact recording methods, because noise while recording is extremely small to such a degree that it can be neglected. Particularly, inkjet recording methods are extremely effective in that they are structurally simple and that they can perform high-speed recording directly onto ordinary medium. As one of the inkjet recording methods, there is an electrostatic inkjet recording method.

The electrostatic inkjet recording apparatus generally has an electrostatic inkjet recording head and a counter electrode which is disposed behind the recording medium to form an electric field between it and the recording head. The electrostatic ink jet recording head has an ink chamber which temporarily stores ink containing toner particles and a plurality of ejection electrodes formed near the end of the ink chamber and directed toward the counter electrode. The ink near the front end of the ejection electrode forms a concave meniscus due to its surface tension, and consequently, the ink is supplied to the front end of the ejection electrode. If positive voltage relative to the counter electrode is supplied to a certain ejection electrode of the head, then the particulate matter in ink will be moved toward the front end of that ejection electrode by the electric field generated between the ejection electrode and the counter electrode. When the coulomb force due to the electric field between the ejection electrode and the counter electrode considerably exceeds the surface tension of the ink liquid, the particulate matter reaching the front end of the ejection electrode is jetted toward the counter electrode as an agglomeration of particulate matter having a small quantity of liquid, and consequently, the jetted agglomeration adheres to the surface of the recording medium. Thus, by applying pulses of positive voltage to a desired ejection electrode, agglomerations of particulate matter are jetted in sequence from the front end of the ejection electrode, and printing is performed. A recording head such as this is disclosed, for example, in PCT International Publication No. WO93/11866.

According to the conventional inkjet recording head, however, the respective ejection electrodes are independently driven by drivers supplying driving voltages depending on input data (see FIG. 4 and page 9, lines 21–31, of the above publication No. WO93/11866). Especially, in the case of a multi-head having an array of dozens of heads or a line head having a linear array of hundreds to thousands of ejection electrodes, it is necessary to provide driver circuits as many as the ejection electrodes, resulting in complicated circuit configuration and the increased amount of hardware. This causes the size and cost of the recording apparatus to be increased.

Further, variations in the positions and shapes of the ejection electrodes inevitably occur in practical manufacturing processes. In such cases, an amount of pigment matter (or toner matter) ejected from an ejection electrode is different from that of another ejection electrode even when the same driving voltage is applied to them, resulting in deteriorated quality of an image formed on a recording medium. More specifically, in the case where an ejection electrode has a more acute tip angle, the electric field is more likely to be concentrated thereon. Therefore, the increased amount of pigment matter is ejected from that ejection electrode, resulting in a larger ink dot formed on a recording paper. Similarly, in the case of variations in distance between an ejection electrode and the counter electrode, the smaller the distance, the larger the ink dot. Furthermore, the electric field is more likely to be concentrated on the ejection electrodes located at both ends, which causes the ink dots at both ends to increase in size. Such variations in ink dot size become more pronounced with the number of ejection electrodes.

SUMMARY OF THE INVENTION

An objective of the present invention is to provide an inkjet apparatus which can eject ink from a plurality of ejection electrodes with precision and with the reduced amount of hardware.

Another objective of the present invention is to provide an apparatus which can reduce the number of ejection electrode drivers.

Further another objective of the present invention is to provide an inkjet recording apparatus and a control method therefor which can achieve the high quality of an image.

Still another objective of the present invention is to provide an inkjet recording apparatus and a control method therefor which can eject a uniform amount of ink from each of a plurality of ejection electrodes.

According to the present invention, an apparatus includes a first number K (K is an integer) of first electrodes each for ejecting an aggregation of particulate matter and a second number M (M is an integer smaller than K) of second electrodes located at a distance from the first electrodes. The K first electrodes are divided into N groups in a way different from the M second electrodes. A selected one of the N groups and a selected one of the M second electrodes are driven to cause ejection of a specified first electrode. The numbers M and N may be determined as two integral numbers which are closest to the square root of K.

In addition to the K first electrodes each for ejecting an aggregation of particulate matter, the apparatus may include K second electrodes located at a distance from the K first electrodes. The K second electrodes correspond to the K first electrodes, respectively, wherein the K second electrodes are divided into M (M is an integer) blocks each having N second electrodes electrically connected in common, where N is K/M.

Further, the apparatus may include a first driving controller and a second driving controller. The first driving controller produces a first voltage pulse to be applied to a selected one of N groups which may be formed by electrically connecting an $i^{th}$ ($1 \leqq i \leqq N$) first electrode for each block to each other. The second driving controller produces a second voltage pulse to be applied to a selected one of the M blocks.

The first and second driving controllers are controlled by a controller to generate a voltage difference between a group and a block which are selected from the N groups and the M blocks depending on an input signal, wherein the voltage difference is equal to or greater than a minimum voltage difference which causes ejection of a first electrode.

The apparatus may be provided with an adjuster which adjusts the second voltage pulse depending on which one is selected from the M blocks so as to provide a substantially uniform amount of ejected particulate matter and applying an adjusted second voltage pulse to the selected one of the M blocks. The adjuster may adjust one of a pulse width and a pulse voltage of the second voltage pulse.

BRIEF DESCRIPTION OF THE DRAWINGS

The above and other objects and advantages will become apparent from the following detailed description when read in conjunction with the accompanying drawings wherein.

DETAILED DESCRIPTION OF THE PREFERRED EMBODIMENTS

Figure 1A:
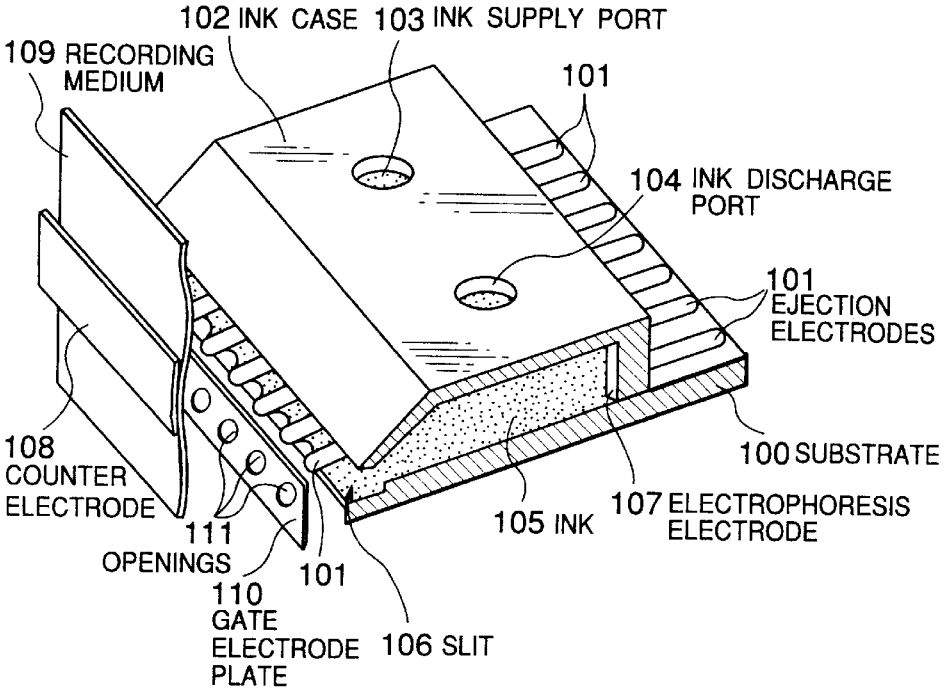
FIG. 1A is a part-fragmentary perspective view showing an inkjet head of an inkjet recording apparatus according to the present invention.
Figure 1B:
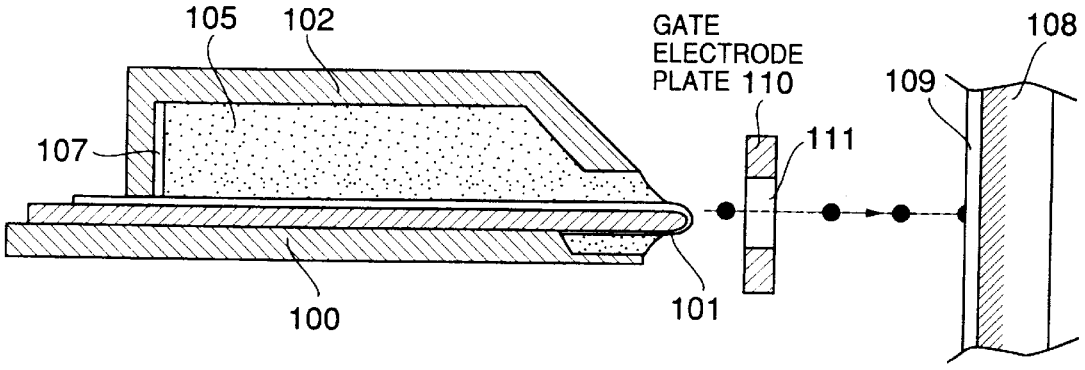
FIG. 1B is a cross sectional view showing the inkjet head as shown in FIG. 1A.

Referring to FIGS. 1A and 1B, there is shown an inkjet recording head to which the present invention can be applied. A substrate 100 is made of an insulator such as plastic and has a plurality of needle-like ejection electrodes 101 formed thereon in accordance with a predetermined pattern. The portions of the ejection electrodes 101 in the ink chamber are covered with an insulating film. An ink case 102 made of an insulating material is mounted on the substrate 100. The ink case 102 is formed with an ink supply port 103 and an ink discharge port 104. The space, defined by the substrate 100 and the ink case 102, constitutes an ink chamber which is filled with ink 105 containing toner particles which is supplied through the ink supply port 103. The front end of the ink case 102 is cut out to form a slit 106 between the ink case 102 and the substrate 100. The ejection ends of the ejection electrodes 101 are disposed in the slit 106.

At the inner rear end of the ink case 102, an electrophoresis electrode 107 is provided within the ink chamber. The ejection electrodes 101 are directed to a counter electrode 108 on which a recording medium 109 is placed.

Further, a gate electrode plate 110 which is provided with a plurality of openings 111 having a gate electrode is placed at a predetermined position between the slit 106 and the counter electrode 108 such that the openings 111 correspond to the ejection electrodes 101, respectively. In other words, a small group of ink particles is jetted from a selected ejection electrode to the recording medium 109 through the corresponding opening of the gate electrode plate 110 as shown in FIG. 1B. Each opening 111 may be shaped like a circle or a slit. As will be described later, the gate electrodes are divided into a plurality of groups such that the gate electrodes of each group are electrically connected in common.

A gate driving voltage $V_G$ is applied to a selected gate electrode and a voltage $V_{EE}$ which is higher than $V_G$ is applied to a selected ejection electrode. A voltage Vc which is lower than $V_G$ is applied to the counter electrode 108. Therefore, if a voltage $V_D$ ($>V_G$) with the same polarity as toner particles is applied to the electrophoresis electrode 107, then an electric field will be generated in the ink chamber, causing toner particles to be moved toward the front ends of the ejection electrodes 101 due to the electrophoresis phenomenon to form meniscuses at the front ends of the ejection electrodes 101. In this state, when an ejection voltage pulse of $V_{EE}$ is applied to the selected ejection electrode to generate a voltage difference more than a threshold between the selected ejection electrode and the corresponding gate electrode, the particulate matter is concentrated onto the front end of that ejection electrode and then jetted to the recording medium 109 though the corresponding opening of the gate electrode plate 110.

First Embodiment

Figure 2:
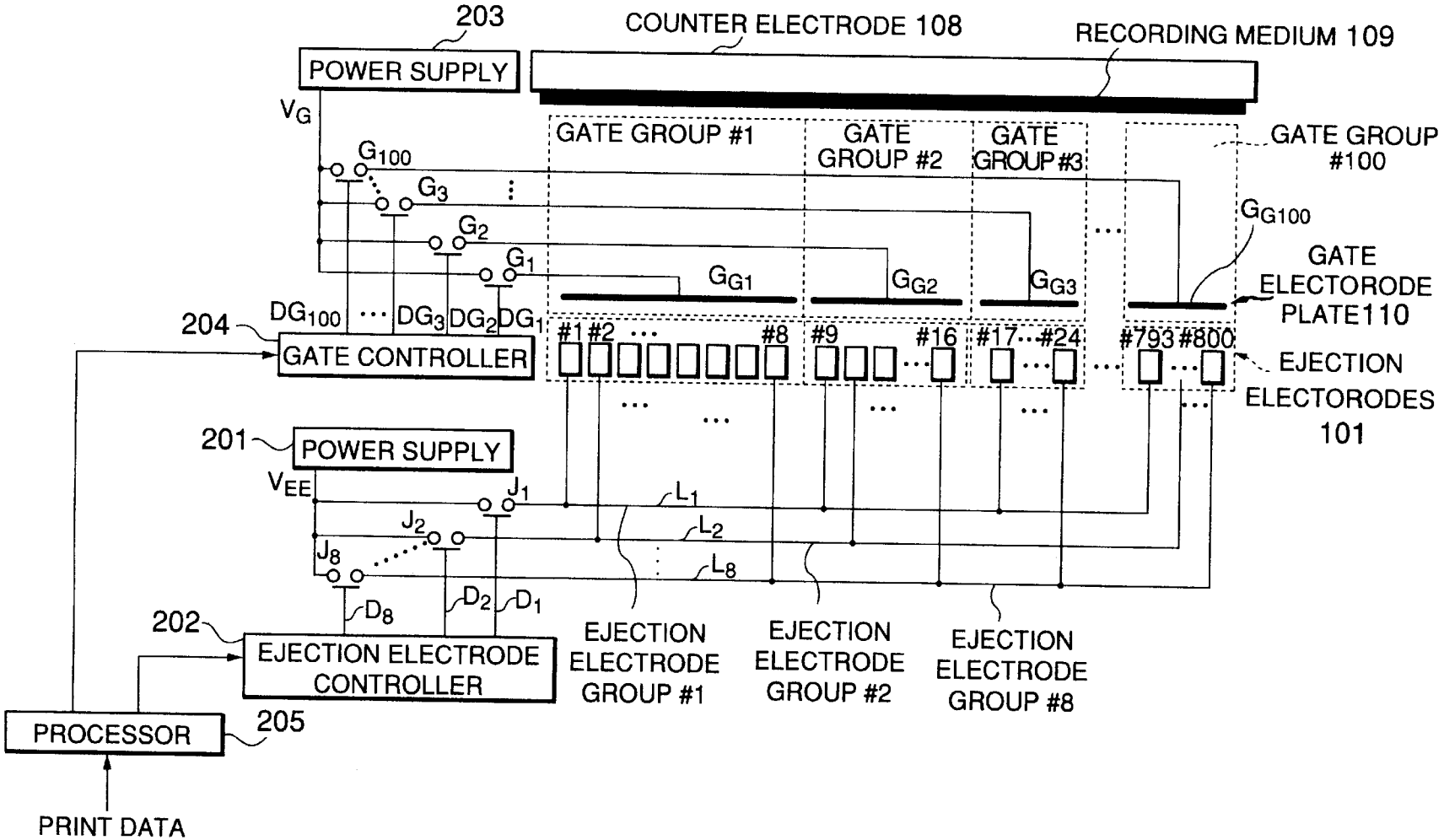
FIG. 2 is a block diagram showing a circuit configuration of the inkjet recording apparatus according to a first embodiment of the present invention.

FIG. 2 shows a circuit of a first embodiment according to the present invention, where elements of the inkjet device similar to those previously described with reference to FIGS. 1A and 1B are denoted by the same reference numerals. In the first embodiment, the gate electrodes of the gate electrode plate 110 are divided into a hundred groups, #1–#100, each having eight gate electrodes which are electrically connected in common to form a gate electrode block: $G_{G1}$–$G_{G100}$. The ejection electrodes 101 number eight hundreds, #1–#800, where a hundred groups of eight ejection electrodes correspond to the gate groups #1–#100, respectively. For example, the first eight ejection electrodes #1–#8 form a first group corresponding to the gate group #1, the second eight ejection electrodes #9–#16 form a second group corresponding to the gate group #2, and so on.

Further, the ejection electrodes 101 are electrically divided into eight ejection electrode groups #1–#8 such that the eight ejection electrodes for each gate group are connected to driving lines $L_1$–$L_8$, respectively. More specifically, the first ejection electrode for each gate group is connected in common to a driving line $L_1$. That is, the ejection electrodes #1, #9, #17, . . . #793 are connected in common to the driving line $L_1$. The second ejection electrode for each gate group is connected in common to a driving line $L_2$. That is, the ejection electrodes #2, #10, #18, . . . #794 are connected in common to the driving line $L_2$. It is the same with the third to eighth ejection electrodes for each gate group.

The driving lines $L_1$–$L_8$ are connected to a power source 201 through driver switches $J_1$–$J_8$, respectively. The respective driver switches $J_1$–$J_8$ receive electrode control signals $D_1$–$D_8$ from an ejection electrode controller 202. The driver switches $J_1$–$J_8$ switch on and off depending on the ejection electrode control signals $D_1$–$D_8$, respectively. The power source 201 generates the driving voltage $V_{EE}$ which is supplied to the driver switches $J_1$–$J_8$. Therefore, depending on the ejection electrode control signals $D_1$–$D_8$, the driving voltage $V_{EE}$ is selectively applied to the driving lines $L_1$–$L_8$.

The gate electrode blocks $G_{G1}$–$G_{G100}$ are connected to a power source 203 through gate driver switches $G_1$–$G_{100}$, respectively. The respective gate driver switches $G_1$–$G_{100}$ receive gate control signals $DG_1$–$DG_{100}$ from a gate controller 204. The gate driver switches $G_1$–$G_{100}$ switch on and off depending on the gate control signals $DG_1$–$DG_{100}$, respectively. The power source 203 generates the gate driving voltage $V_G$ ($<V_{EE}$) which is supplied to the gate driver switches $G_1$–$G_{100}$. Therefore, depending on the gate control signals $DG_1$–$DG_{100}$, the gate driving voltage $V_G$ is selectively applied to the gate electrode blocks $G_{G1}$–$G_{G100}$.

Ink ejection from an ejection electrode requires that a voltage difference between the ejection electrode and the corresponding gate electrode is equal to or greater than a predetermined threshold value $V_{th}$. In other words, when the voltage difference is not smaller than the threshold value $V_{th}$, an aggregation of toner matter is ejected from that ejection electrode toward the counter electrode 108 through the corresponding gate electrode. If the voltage difference is smaller than the threshold value $V_{th}$, the ink ejection from that ejection electrode cannot occur. Therefore, by controlling the voltage difference between each ejection electrode and the corresponding gate electrode, the particulate matter is selectively ejected from the ejection electrodes. In the embodiment, the voltage $V_{EE}$ applied to the ejection electrodes 101 is lower than the threshold value $V_{th}$ but the voltage difference ($V_{EE}$–$V_G$) is equal to or greater than the threshold value $V_{th}$. Therefore, by producing the voltage difference ($V_{EE}$–$V_G$) between a selected gate electrode block and a selected ejection electrode group, the ink can be ejected from a desired ejection electrode.

The ejection electrode controller 202 and the gate controller 204 are controlled by a processor 205 performing image formation control according to input print data. The details of the control will be described hereinafter.

Figure 3:
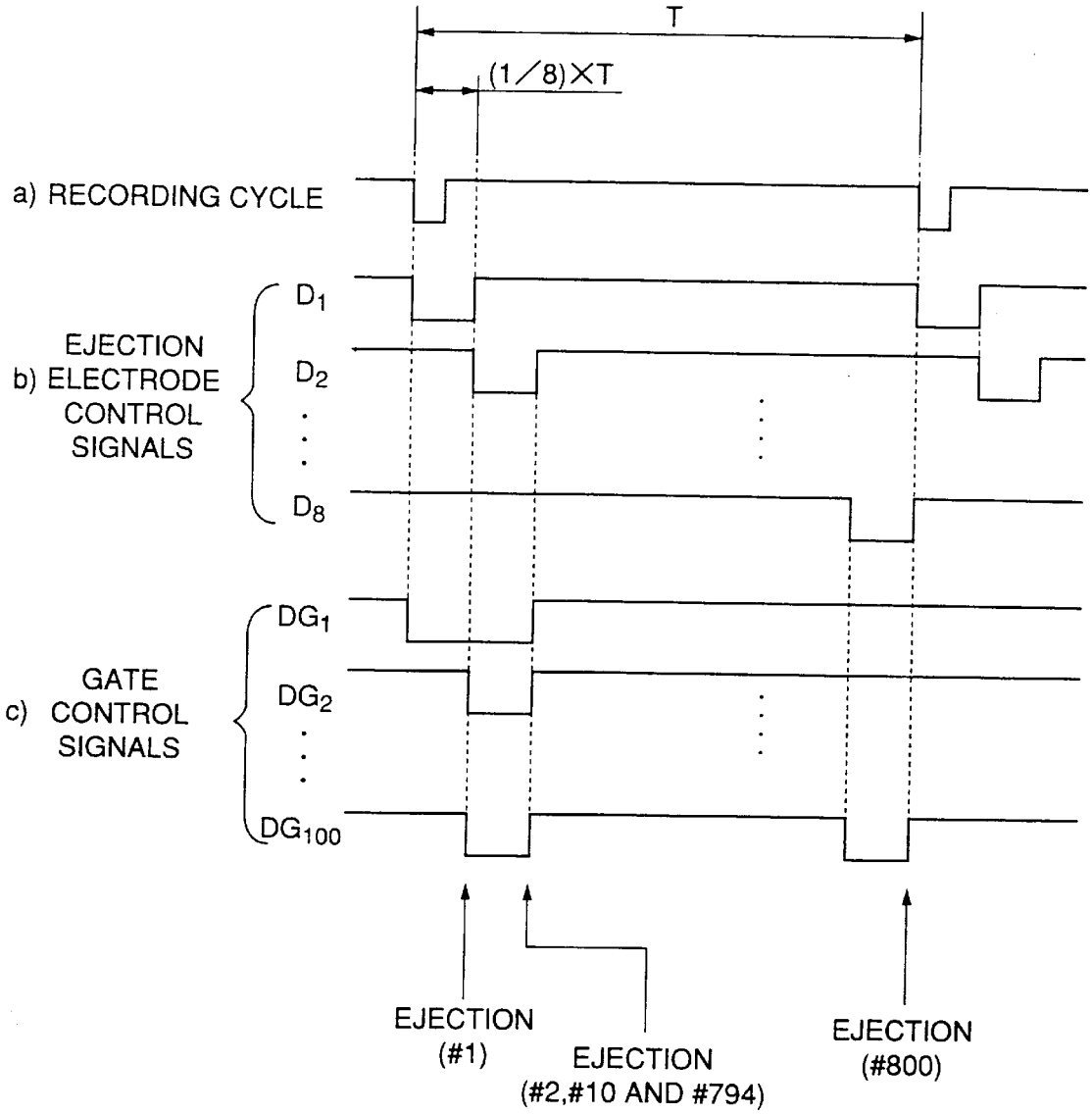
FIG. 3 is a time chart showing control signals for ejection electrodes and gate electrodes of the inkjet recording apparatus according to the first embodiment.

Referring to FIG. 3, the ejection electrode controller 202 sequentially outputs the electrode control signals $D_1$–$D_8$ to the driver switches $J_1$–$J_8$, respectively, during a recording period T. The pulse width of each electrode control signal is set to a time slot obtained by dividing the recording period T by the number of the electrode control signals $D_1$–$D_8$. In other words, the recording period T is time-divided into eight time slots each having a time period of T/8. In parallel with the ejection electrode controller 202, the gate controller 204 selectively outputs the gate control signals $DG_1$–$DG_{100}$ to the gate driver switches $G_1$–$G_{100}$, respectively, under the control of the processor 205. In this embodiment, the pulse width of each gate control signal is set to the same time slot as each ejection electrode control signal.

More specifically, when receiving a recording timing pulse from the processor 205, the ejection electrode controller 202 generates the electrode control signals $D_1$–$D_8$ in sequence as shown in b) of FIG. 3. For example, when the electrode control signal $D_1$ falls on the falling edge of the recording timing pulse, the driver switch $J_1$ is closed to apply the voltage $V_{EE}$ to the ejection electrodes #1, #9, #17, . . . #793 through the driving line $L_1$. When the electrode control signal $D_2$ falls after the electrode control signal $D_1$ has risen, the voltage $V_{EE}$ is applied to the ejection electrodes #2, #10, #18, . . . #794 through the driving line $L_2$. It is the same with other electrode control signals $D_3$–$D_8$.

When the gate control signal $DG_1$ falls on the falling edge of the recording timing pulse, the gate driver switch $G_1$ is closed to apply the gate driving voltage $V_G$ to the first gate electrode block $G_{G1}$ of the gate group #1. Since the voltage $V_{EE}$ is applied to the ejection electrodes #1, #9, #17, . . . #793 during the first time slot, the voltage difference $V_{EE}$–$V_G$ which is greater than the threshold voltage $V_{th}$ is generated between the first ejection electrode #1 and the corresponding gate electrode of the gate group #1. Therefore, on the rising edge of the electrode control signal $D_1$, the ink is ejected only from the first ejection electrode #1.

Subsequently, when the electrode control signal $D_2$ falls in the second time slot, the driver switch $J_2$ is closed to apply the voltage $V_{EE}$ to the ejection electrodes #2, #10, #18, . . . #794 through the driving line $L_2$. In the same time slot, when the gate control signals $DG_1$, $DG_2$ and $DG_{100}$ fall, the gate driver switches $G_1$, $G_2$ and $G_{100}$ are closed to apply the gate driving voltage $V_G$ to the gate electrode blocks $G_{G1}$, $G_{G2}$ and $G_{G100}$. Since the voltage $V_{EE}$ is applied to the ejection electrodes #2, #10, #18, . . . #794 during the second time slot, the voltage difference $V_{EE}$–$V_G$ is generated between each of the ejection electrodes #2, #10 and #794 and the corresponding gate electrode. Therefore, on the rising edge of the electrode control signal $D_2$, the ink is ejected from each of the ejection electrodes #2, #10 and #794. Similarly, when the electrode control signal $D_8$ and the gate control signal $DG_{100}$ fall in the last time slot, only the last ejection electrode #800 ejects the ink.

As described above, only a total of one hundred and eight driver circuits including a hundred gate driver switches $G_1$–$G_{100}$ and eight driver switches $J_1$–$J_8$ can drive the eight hundreds ejection electrodes #1–#800.

The present invention is not limited to the combination of the 100 gate driver switches and the 8 driver switches as shown in FIG. 2. Another combination may be possible. For example, in the case of a combination of 50 gate driver switches and 16 driver switches, only a total of sixty-six driver circuits can also drive the eight hundreds ejection electrodes #1–#800. In the case of a combination of 25 gate driver switches and 32 driver switches, the minimized number of driver circuits may be obtained. In summary, if the number of ejection electrodes to be driven is K, the number of gate driver switches is M, and the number of driver switches is N, then the total number (M+N) is minimized when both M and N equal to the square root of K. Since both M and N are integral numbers, a pair of integral numbers M and N which are closest to the square root of K is a solution.

Second Embodiment

Figure 4:
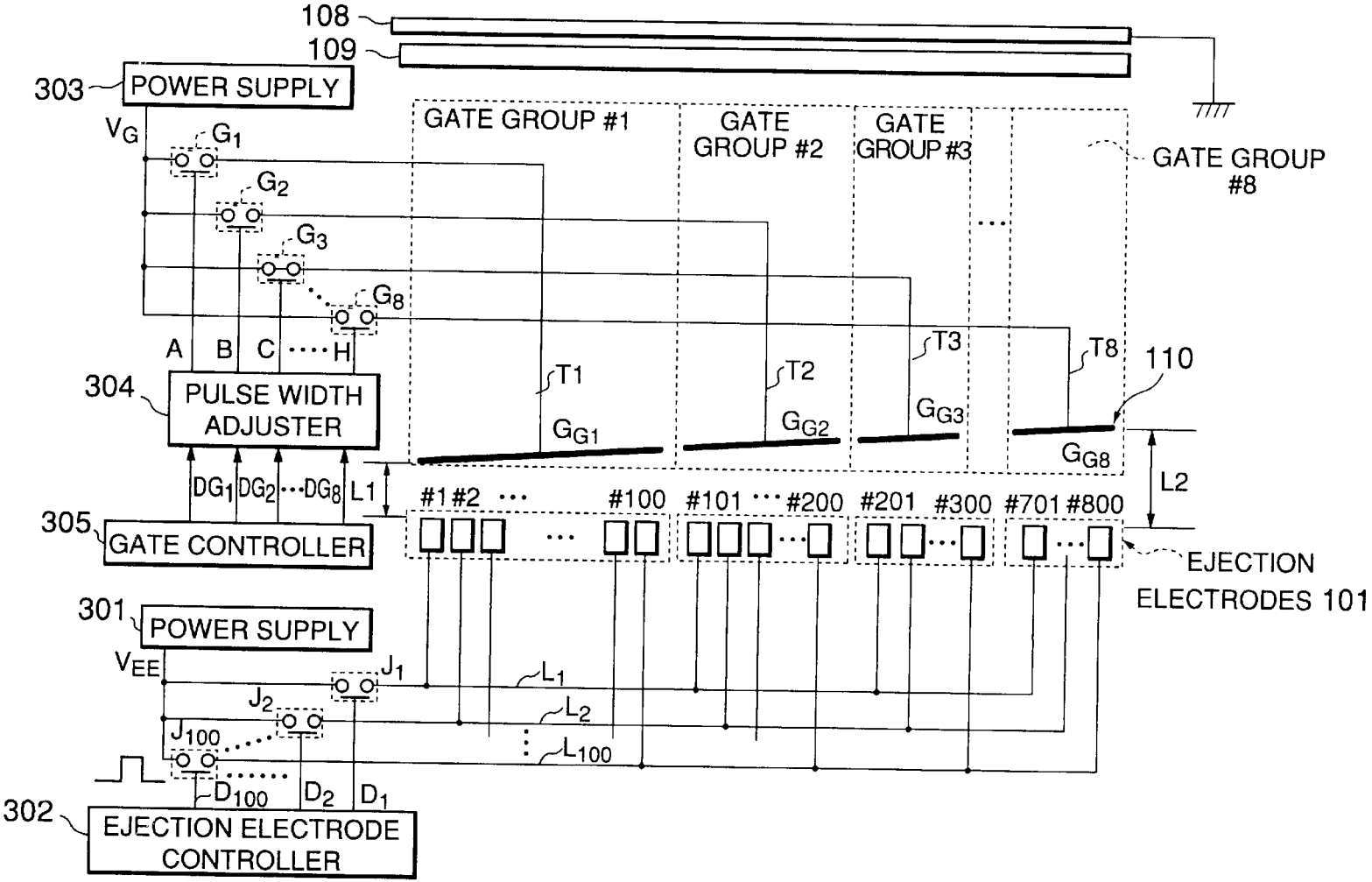
FIG. 4 is a block diagram showing a circuit configuration of the inkjet recording apparatus according to a second embodiment of the present invention.

FIG. 4 shows a circuit of a second embodiment according to the present invention, where elements of the inkjet device similar to those previously described with reference to FIGS. 1A and 1B are denoted by the same reference numerals. It is assumed that the gate electrode plate 110 is not parallel with the array of the ejection electrodes 101 due to variations in the position and shape of the gate electrode plate 110 or the array of the ejection electrodes 101. Here, for simplicity, the distance between each ejection electrode and the corresponding gate electrode are changed with the number of ejection electrode. For example, the distance L1 at one end between the first ejection electrode #1 and the corresponding gate electrode is shorter than the distance L2 at the other end between the last ejection electrode #800 and the corresponding gate electrode. Such variations cause variations in amount of ejected ink. In the second embodiment, variations in amount of ejected ink can be eliminated by adjusting the pulse width of a gate control signal as will be described later.

As shown in FIG. 4, the gate electrodes of the gate electrode plate 110 are divided into eight groups, #1–#8, each having a hundred gate electrodes which are electrically connected in common to form a gate electrode block: $G_{G1}$–$G_{G8}$. The ejection electrodes 101 number eight hundreds, #1–#800, where eight groups of a hundred ejection electrodes correspond to the gate groups #1–#8, respectively. For example, the ejection electrodes #1–#100 form a first group corresponding to the gate group #1, the ejection electrodes #101–#200 form a second group corresponding to the gate group #2, and so on.

Further, the ejection electrodes 101 are electrically divided into a hundred ejection electrode groups such that the hundred ejection electrodes for each gate group are connected to driving lines $L_1$–$L_{100}$, respectively. More specifically, the first ejection electrode for each gate group is connected in common to a driving line $L_1$. That is, the ejection electrodes #1, #101, #201, . . . #701 are connected in common to the driving line $L_1$. The second ejection electrode for each gate group is connected in common to a driving line $L_2$. That is, the ejection electrodes #2, #102, #202, . . . #702 are connected in common to the driving line $L_2$. It is the same with the third to hundredth ejection electrodes for each gate group.

The driving lines $L_1$–$L_{100}$ are connected to a power source 301 through driver switches $J_1$–$J_{100}$, respectively. The respective driver switches $J_1$–$J_{100}$ receive electrode control signals $D_1$–$D_{100}$ from an ejection electrode controller 302. The driver switches $J_1$–$J_{100}$ switch on and off depending on the ejection electrode control signals $D_1$–$D_{100}$, respectively. The power source 301 generates the driving voltage $V_{EE}$ which is supplied to the driver switches $J_1$–$J_{100}$. Therefore, depending on the ejection electrode control signals $D_1$–$D_{100}$, the driving voltage $V_{EE}$ is selectively applied to the driving lines $L_1$–$L_{100}$.

The gate electrode blocks $G_{G1}$–$G_{G8}$ are connected to a power source 303 through gate driver switches $G_1$–$G_8$, respectively. The respective gate driver switches $G_1$–$G_8$ receive gate control signals A–H from a pulse width adjuster 304 which receives control signals $DG_1$–$DG_8$ from a gate controller 305. The pulse width adjuster 304 generates the gate control signals A–H each having a pulse width which is adjusted so as to cancel the effect due to the variations in position and shape of the gate electrode plate 110 or the ejection electrodes 101. More specifically, the respective gate control signals A–H have pulse widths T1–T8 corresponding to the gate electrode blocks $G_{G1}$–$G_{G8}$.

The gate driver switches $G_1$–$G_8$ switch on and off depending on the gate control signals A–H, respectively. The power source 303 generates the gate driving voltage $V_G$ ($<V_{EE}$) which is supplied to the gate driver switches $G_1$–$G_8$. Therefore, depending on the gate control signals A–H, the gate driving voltage $V_G$ is selectively applied to the gate electrode blocks $G_{G1}$–$G_{G8}$.

As described before, the voltage $V_{EE}$ applied to the ejection electrodes 101 is lower than the threshold value $V_{th}$ but the voltage difference ($V_{EE}$–$V_G$) is equal to or greater than the threshold value $V_{th}$. Therefore, by producing the voltage difference ($V_{EE}$–$V_G$) between a selected gate electrode block and a selected ejection electrode group, the ink can be ejected from a desired ejection electrode. Further, an adjusted pulse width of each voltage pulse applied to the corresponding gate electrode block can provide a uniform amount of ejected ink even in the case where there are variations in distance between each ejection electrode and the corresponding gate electrode.

The ejection electrode controller 302 and the gate controller 305 are controlled by a processor (not shown in this figure) performing image formation control according to input print data. The details of the control will be described hereinafter.

Figure 5:
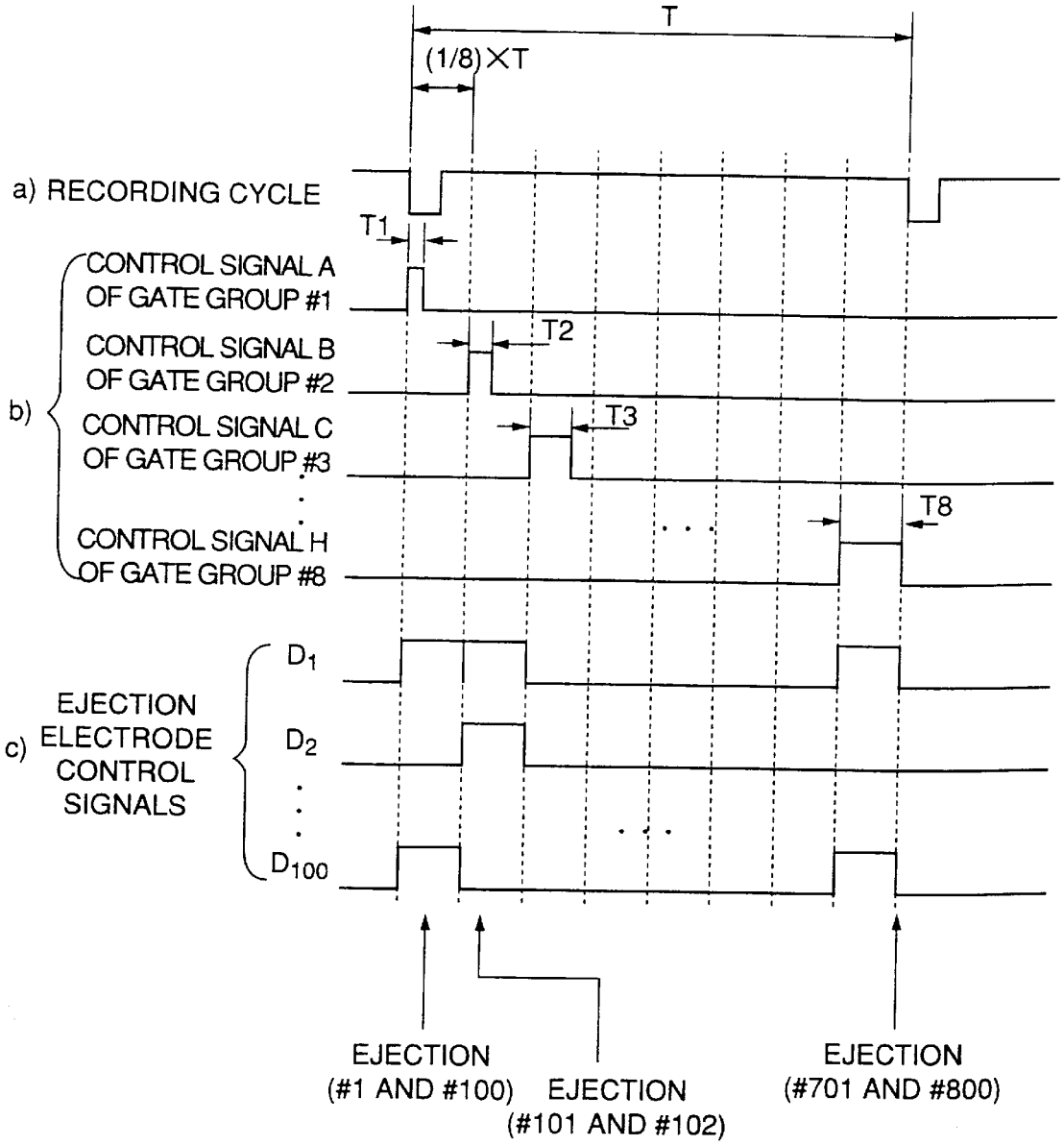
FIG. 5 is a time chart showing control signals for ejection electrodes and gate electrodes of the inkjet recording apparatus according to the second embodiment.

Referring to FIG. 5, the gate controller 305 sequentially outputs the control signals $DG_1$–$DG_8$ to the pulse width adjuster 304 which in turn outputs the gate control signals A–H to the gate driver switches $G_1$–$G_8$, respectively, during a recording period T. The pulse width of each control signal is set to a time slot obtained by dividing the recording period T by the number of the gate blocks $G_{G1}$–$G_{G8}$. In other words, the recording period T is time-divided into eight time slots each having a time period of T/8. The pulse width adjuster 304 generates the gate control signals A–H which correspond to the control signals $DG_1$–$DG_8$, respectively, with each gate control signal changing in pulse width within a time slot of T/8.

More specifically, as shown in b) of FIG. 5, the respective pulse widths of the gate control signals A–H are set to time periods T1–T8 which become longer in the order presented, that is, T1<T2<T3<T4<T5<T6<T7<T8<T/8. As described before, the pulse width of each gate control signal is adjusted so as to provide a uniform amount of ejected ink. Therefore, the pulse widths may be changed depending on variations in the positions and shapes of the gate electrode plate 110 and the ejection electrodes 101.

In parallel with the pulse width adjuster 304 and the gate controller 305, the ejection electrode controller 302 selectively outputs the ejection electrode control signals $D_1$–$D_{100}$ to the driver switches $J_1$–$J_{100}$, respectively, under the control of the processor. In this embodiment, the pulse width of each ejection electrode control signal is set to a time period of T/8 or less.

More specifically, when receiving a recording timing pulse from the processor, the gate controller 305 generates the control signals $DG_1$–$DG_8$ in sequence, which cause the pulse width adjuster 304 to generate the gate control signals A–H whose pulse widths are adjusted as shown in b) of FIG. 5. For example, when the gate control signal A of T1 rises on the falling edge of the recording timing pulse, the gate driver switch $G_1$ is closed to apply the voltage $V_G$ to the gate block $G_{G1}$ during the time period T1. When the gate control signal B of T2 rises after the gate control signal A has fallen, the voltage $V_G$ is applied to the gate block $G_{G2}$ during the time period T2. It is the same with other gate control signals C–H.

When the ejection electrode control signals $D_1$ and $D_{100}$ rise on the falling edge of the recording timing pulse, the driver switches $J_1$ and $J_{100}$ are closed during the first time slot to apply the driving voltage $V_{EE}$ to the ejection electrodes #1, #101, #201, . . . #701 and the ejection electrodes #100, #200, . . . #800 through the driving lines $L_1$ and $L_{100}$, respectively. Since the voltage $V_G$ is applied to the gate block $G_{G1}$ during the time period T1, the voltage difference $V_{EE}$–$V_G$ which is greater than the threshold voltage $V_{th}$ is generated between each of the ejection electrodes #1 and #100 and the gate block $G_{G1}$. Therefore, on the falling edge of the gate control signal A, the ink is ejected only from the ejection electrodes #1 and #100.

Subsequently, when the gate control signal B rises in the second time slot, the gate driver switch $G_2$ is closed during the time period T2 to apply the voltage $V_G$ to the gate block $G_{G2}$. When the ejection electrode control signals $D_1$ and $D_2$ rise in the second time slot, the driver switches $J_1$ and $J_2$ are closed during the second time slot to apply the driving voltage $V_{EE}$ to the ejection electrodes #1, #101, #201, . . . #701 and the ejection electrodes #2, #102, . . . #702 through the driving lines $L_1$ and $L_2$, respectively. Since the voltage $V_G$ is applied to the gate block $G_{G2}$ during the time period T2, the voltage difference $V_{EE}$–$V_G$ which is greater than the threshold voltage $V_{th}$ is generated between each of the ejection electrodes #101 and #102 and the gate block $G_{G2}$. Therefore, on the falling edge of the gate control signal B, the ink is ejected only from the ejection electrodes #101 and #102. Similarly, when the gate control signal H and the ejection electrode control signals $D_1$ and $D_{100}$ rise in the last time slot, only the ejection electrodes #701 and #800 eject the ink.

Third Embodiment

Figure 6:
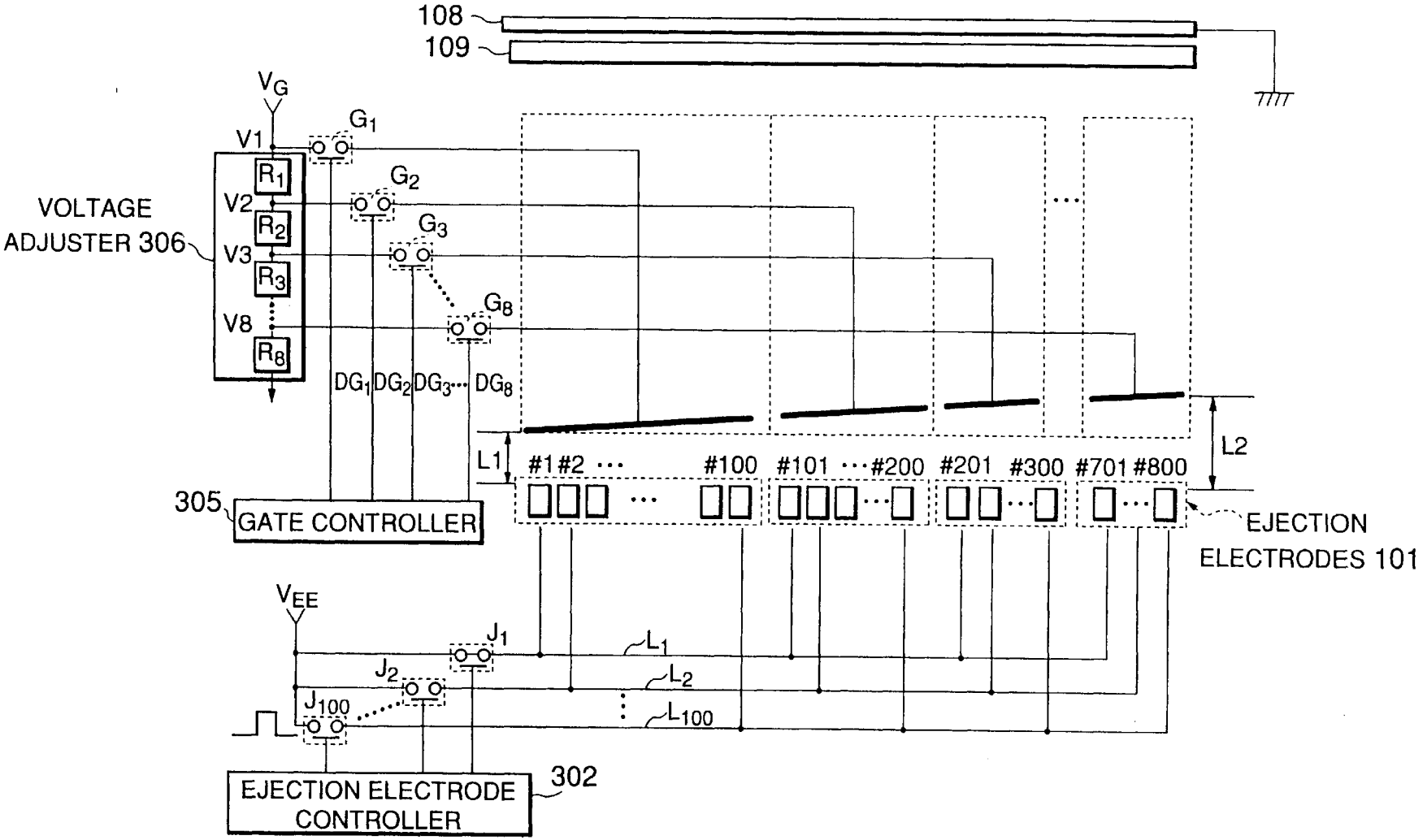
FIG. 6 is a block diagram showing a circuit configuration of the inkjet recording apparatus according to a third embodiment of the present invention.

FIG. 6 shows a circuit of a third embodiment according to the present invention, where elements of the inkjet device similar to those previously described with reference to FIG. 4 are denoted by the same reference numerals and their details are omitted. As in the case of the second embodiment, it is also assumed that the gate electrode plate 110 is not parallel with the array of the ejection electrodes 101 due to variations in the position or shape of the gate electrode plate 110 or the array of the ejection electrodes 101. In the third embodiment, variations in amount of ejected ink can be substantially eliminated by adjusting a voltage applied to each gate electrode block as will be described later.

Referring to FIG. 6, there is provided a voltage adjuster 306 connecting the power source 303 (not shown in this figure) and the gate driver switches $G_1$–$G_8$. The voltage adjuster 306 is composed of a voltage divider having resistors $R_1$–$R_8$ connected in series to divide the gate driving voltage $V_G$ into eight gate driving voltages V1–V8. In this embodiment, the gate driving voltages V1–V8 become lower in the order presented, that is, $V_{EE}>V_G=$ V1>V2>V3>V4>V5>V6>V7>V8. Therefore, a voltage difference ($V_{EE}$–V1) between the gate electrode block $G_{G1}$ and the ejection electrode #1 becomes smallest and a voltage difference ($V_{EE}$–V8) between the gate electrode block $G_{G8}$ and the ejection electrode #800 becomes greatest. The uneven gate driving voltages like these can reduce variations in electric field between an ejection electrode and the corresponding gate electrode, resulting in uniform amount of ejected ink.

Since the gate driving voltages V1–V8 are adjusted so as to provide a uniform amount of ejected ink, a distribution of the gate driving voltages V1–V8 may be changed depending on variations in the positions and shapes of the gate electrode plate 110 and the ejection electrodes 101. The gate driver switches $G_1$–$G_8$ switch on and off depending on the control signals $DG_1$–$DG_8$ received from the gate controller 305 and apply the adjusted gate driving voltages V1–V8 to the gate electrode blocks $G_{G1}$–$G_{G8}$, respectively.

Figure 7:
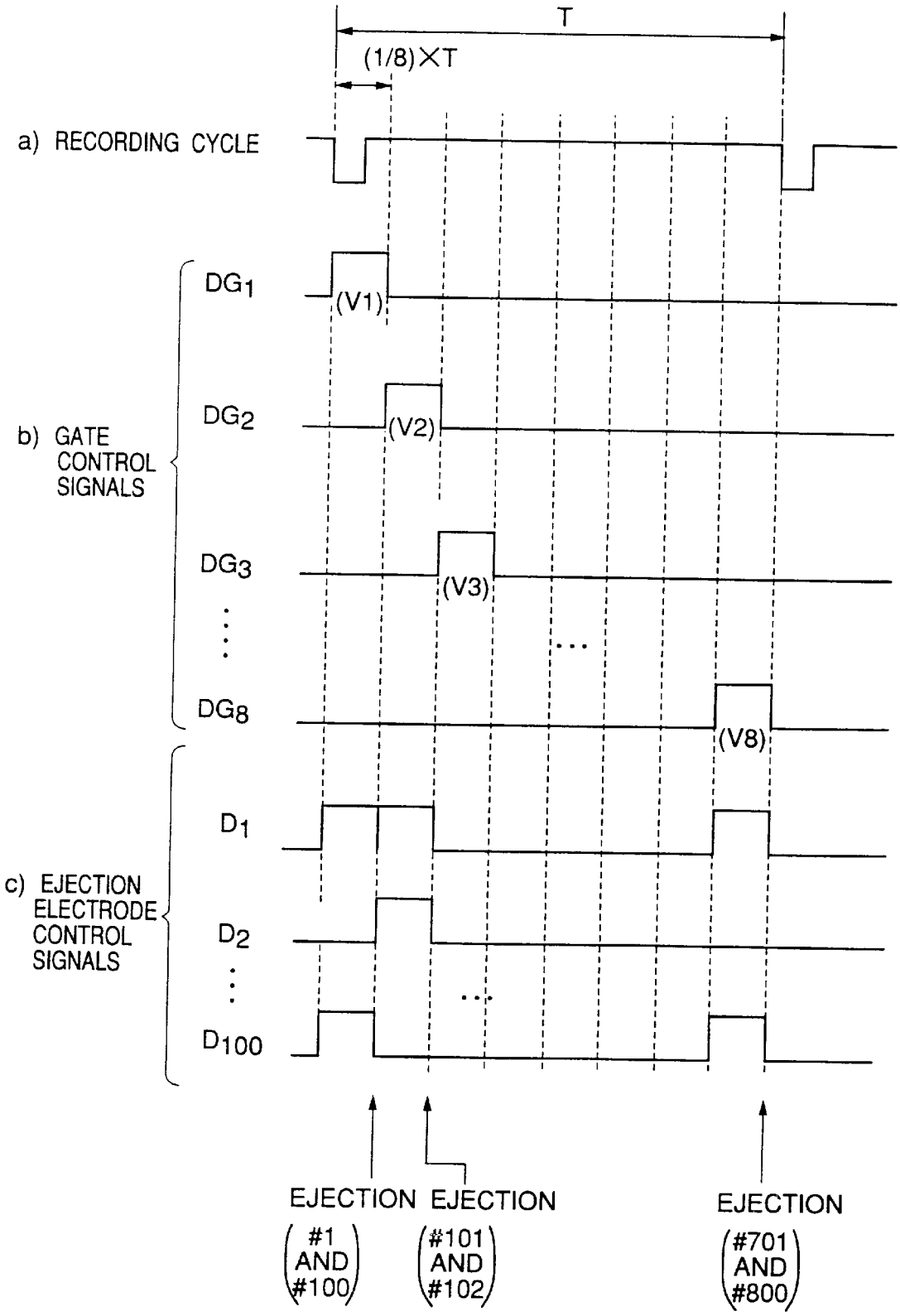
FIG. 7 is a time chart showing control signals for ejection electrodes and gate electrodes of the inkjet recording apparatus according to the third embodiment.

Referring to FIG. 7, the gate controller 305 sequentially outputs the gate control signals $DG_1$–$DG_8$ to the gate driver switches $G_1$–$G_8$, respectively, during a recording period T. The pulse width of each gate control signal is set to a time slot obtained by dividing the recording period T by the number of the gate blocks $G_{G1}$–$G_{G8}$. In other words, the recording period T is time-divided into eight time slots each having a time period of T/8. In parallel with the gate controller 305, the ejection electrode controller 302 selectively outputs the ejection electrode control signals $D_1$–$D_{100}$ to the driver switches $J_1$–$J_{100}$, respectively, under the control of the processor. In this embodiment, the pulse width of each ejection electrode control signal is set to a time period of T/8 or less.

More specifically, when receiving a recording timing pulse from the processor, the gate controller 305 generates the gate control signals $DG_1$–$DG_8$ in sequence as shown in b) of FIG. 7. For example, when the gate control signal $DG_1$ rises on the falling edge of the recording timing pulse, the gate driver switch $G_1$ is closed to apply the voltage V1 (=$V_G$) to the gate block $G_{G1}$ during the first time slot. When the gate control signal $DG_2$ rises after the gate control signal $DG_1$ has fallen, the voltage V2 (<V1) is applied to the gate block $G_{G2}$ during the second time slot. It is the same with other gate control signals $DG_3$–$DG_8$.

When the ejection electrode control signals $D_1$ and $D_{100}$ rise on the falling edge of the recording timing pulse, the driver switches $J_1$ and $J_{100}$ are closed during the first time slot to apply the driving voltage $V_{EE}$ to the ejection electrodes #1, #101, #201, . . . #701 and the ejection electrodes #100, #200, . . . #800 through the driving lines $L_1$ and $L_{100}$, respectively. Since the voltage V1 is applied to the gate block $G_{G1}$, the voltage difference $V_{EE}$–V1 which is greater than the threshold voltage $V_{th}$ is generated between each of the ejection electrodes #1 and #100 and the gate block $G_{G1}$. Therefore, on the falling edge of the gate control signal $DG_1$, the ink is ejected only from the ejection electrodes #1 and #100.

Subsequently, when the gate control signal $DG_2$ rises in the second time slot, the gate driver switch $G_2$ is closed to apply the voltage V2 to the gate block $G_{G2}$. When the ejection electrode control signals $D_1$ and $D_2$ rise in the second time slot, the driver switches $J_1$ and $J_2$ are closed during the second time slot to apply the driving voltage $V_{EE}$ to the ejection electrodes #1, #101, #201, . . . #701 and the ejection electrodes #2, #102, . . . #702 through the driving lines $L_1$ and $L_2$, respectively. Since the voltage V2 is applied to the gate block $G_{G2}$ during the second time slot, the voltage difference $V_{EE}$–V2 which is greater than the threshold voltage $V_{th}$ is generated between each of the ejection electrodes #101 and #102 and the gate block $G_{G2}$. Therefore, on the falling edge of the gate control signal $DG_2$, the ink is ejected only from the ejection electrodes #101 and #102. Similarly, when the gate control signal $DG_8$ and the ejection electrode control signals $D_1$ and $D_{100}$ rise in the last time slot, only the ejection electrodes #701 and #800 eject the ink.

In the second embodiment, variations in amount of ejected ink can be substantially eliminated by adjusting the pulse width of a gate control signal. In the third embodiment, variations in amount of ejected ink can be substantially eliminated by adjusting a voltage applied to each gate electrode. As a fourth embodiment, a combination of the second and third embodiments may be possible. That is, variations in amount of ejected ink can be substantially eliminated by adjusting both the pulse width and the voltage of a voltage pulse applied to a gate electrode.

The present invention is not limited to the combination of the 8 gate driver switches and the 100 driver switches as shown in FIGS. 4 and 6. Another combination may be possible as in the case of FIG. 2. However, in the second and third embodiments, the pulse width adjuster 304 and the voltage adjuster 306 are needed, respectively. Therefore, it may be preferable that the number of driver switches in the side of the pulse width adjuster 304 or the voltage adjuster 306 is smaller than that of driver switches in the other side.

While the invention has been described with reference to specific embodiments thereof, it will be appreciated by those skilled in the art that numerous variations, modifications, and any combination of the first and second embodiments are possible, and accordingly, all such variations, modifications, and combinations are to be regarded as being within the scope of the invention.

What is claimed is:

1. An apparatus comprising:

a first number K (K is an integer) of first electrodes each for ejecting an aggregation of particulate matter;

a second number M (M is an integer smaller than K) of second electrodes located at a distance from the first electrodes;

a first driving controller for driving a selected one of N groups into which the K first electrodes are divided; and a second driving controller for driving a selected one of the M second electrodes, wherein ejection of a desired first electrode is caused by driving a selected one of the N groups and a selected one of the M second electrodes.

2. The apparatus according to claim 1, wherein the first driving controller sequentially selects one by one from the N groups in a predetermined period divided into N time slots and drives a selected one in a time slot; and the second driving controller drives at least one selected one of the M second electrodes in the time slot to cause the ejection of at least one first electrode.

3. The apparatus according to claim 1, wherein the second driving controller sequentially selects one by one from the M second electrodes in a predetermined period divided into N time slots and drives a selected one in a time slot; and the first driving controller drives at least one selected one of the N groups in the time slot to cause the ejection of at least one first electrode.

4. The apparatus according to claim 1, wherein M and N are determined as two integral numbers which are closest to the square root of K.

5. The apparatus according to claim 1, wherein each of the M second electrodes comprises N gate electrodes which are electrically connected in common, a total of K (K=M×N) gate electrodes corresponding to the K first electrodes, respectively, wherein each first electrode ejects an aggregation of particulate matter through a gate electrode corresponding to the first electrode.

6. The apparatus according to claim 5, wherein the first driving controller sequentially selects one by one from the N groups in a predetermined period divided into N time slots and drives a selected one in a time slot; and the second driving controller drives at least one selected one of the M second electrodes in the time slot to cause the ejection of at least one first electrode.

7. The apparatus according to claim 5, wherein the second driving controller sequentially selects one by one from the M second electrodes in a predetermined period divided into N time slots and drives a selected one in a time slot; and the first driving controller drives at least one selected one of the N groups in the time slot to cause the ejection of at least one first electrode.

8. An apparatus comprising:

a first number K (K is an integer) of first electrodes each for ejecting an aggregation of particulate matter;

K second electrodes located at a distance from the K first electrodes, the K second electrodes corresponding to the K first electrodes, respectively, wherein the K second electrodes are divided into M (M is an integer) blocks each having N second electrodes electrically connected in common, where N is K/M;

a first driving controller for producing a first voltage pulse to be applied to a selected one of N groups into which the K first electrodes are divided in a different way from the M blocks;

a second driving controller for producing a second voltage pulse to be applied to a selected one of the M blocks; and a controller for controlling the first and second driving controller to generate a voltage difference between a group and a block which are selected from the N groups and the M blocks depending on an input signal, wherein the voltage difference is equal to or greater than a minimum voltage difference which causes ejection of a first electrode.

9. The apparatus according to claim 8, wherein each of the N groups is formed by electrically connecting an $i^{th}$ ($1 \leqq i \leqq N$) first electrode for each block to each other.

10. The apparatus according to claim 8, wherein the second driving controller comprises:

an adjuster for adjusting the second voltage pulse depending on which one is selected from the M blocks so as to provide a substantially uniform amount of ejected particulate matter and applying an adjusted second voltage pulse to the selected one of the M blocks.

11. The apparatus according to claim 10, wherein the adjuster is a pulse width adjuster for adjusting a pulse width of the second voltage pulse.

12. The apparatus according to claim 10, wherein the adjuster is a voltage adjuster for adjusting a voltage of the second voltage pulse.

13. The apparatus according to claim 10, wherein the second electrodes are gate electrodes corresponding to the K first electrodes, respectively, wherein each first electrode ejects an aggregation of particulate matter through a gate electrode corresponding to the first electrode.

14. The apparatus according to claim 13, wherein the first driving controller sequentially selects one by one from the N groups in a predetermined period divided into N time slots and applies the first voltage pulse to a selected one in a time slot; and the second driving controller applies the second voltage pulse to at least one selected one of the M blocks in the time slot to cause the ejection of at least one first electrode.

15. The apparatus according to claim 13, wherein the second driving controller sequentially selects one by one from the M blocks in a predetermined period divided into N time slots and applies the second voltage pulse to a selected one in a time slot; and the first driving controller applies the first voltage pulse to at least one selected one of the N groups in the time slot to cause the ejection of at least one first electrode.

16. The apparatus according to claim 13, wherein M and N are determined as two integral numbers which are closest to the square root of K.

17. An electrostatic inkjet recording apparatus comprising:

a first number K (K is an integer) of ejection electrodes each for ejecting an aggregation of particulate matter;

K gate electrodes located at a distance from the K ejection electrodes, the K gate electrodes corresponding to the K ejection electrodes, respectively, wherein the K gate electrodes are divided into M (M is an integer) blocks each having N gate electrodes electrically connected in common, where N is K/M;

a first driving controller for applying a first voltage pulse to a selected one of N groups each formed by electrically connecting an $i^{th}$ ($1 \leqq i \leqq N$) ejection electrode for each block to each other;

a second driving controller for applying a second voltage pulse to a selected one of the M blocks; and a processor for controlling the first and second driving controller to generate a voltage difference between a group and a block which are selected from the N groups and the M blocks depending on an input signal, wherein the voltage difference is equal to or greater than a minimum voltage difference which causes ejection of an ejection electrode.

18. The electrostatic inkjet recording apparatus according to claim 17, wherein the first driving controller sequentially selects one by one from the N groups in a predetermined period divided into N time slots and applies the first voltage pulse to a selected one in a time slot; and the second driving controller applies the second voltage pulse to at least one selected one of the M blocks in the time slot to cause the ejection of at least one ejection electrode.

19. The electrostatic inkjet recording apparatus according to claim 17, wherein the second driving controller sequentially selects one by one from the M blocks in a predetermined period divided into N time slots and applies the second voltage pulse to a selected one in a time slot; and the first driving controller applies the first voltage pulse to at least one selected one of the N groups in the time slot to cause the ejection of at least one ejection electrode.

20. The electrostatic inkjet recording apparatus according to claim 17, wherein M and N are determined as two integral numbers which are closest to the square root of K.

21. The electrostatic inkjet recording apparatus according to claim 17, wherein the second driving controller comprises:

an adjuster for adjusting the second voltage pulse depending on which one is selected from the M blocks so as to provide a substantially uniform amount of ejected particulate matter and applying an adjusted second voltage pulse to the selected one of the M blocks.

22. The electrostatic inkjet recording apparatus according to claim 21, wherein the adjuster is a pulse width adjuster for adjusting a pulse width of the second voltage pulse.

23. The electrostatic inkjet recording apparatus according to claim 21, wherein the adjuster is a voltage adjuster for adjusting a voltage of the second voltage pulse.

24. A control method for an inkjet recording apparatus including K first electrodes each for ejecting an aggregation of particulate matter and K second electrodes located at a distance from the K first electrodes, the K second electrodes corresponding to the K ejection electrodes, respectively, where K is an integer, the control method comprising the steps of:

a) selecting one of N groups formed by dividing the K first electrodes in a first way;

b) selecting one of M blocks formed by dividing the K second electrodes in a second way different from the first way; and c) driving a selected one of the N groups and a selected one of the M blocks to eject an aggregation of particulate matter from a first electrode specified by the selected one of the N groups and the selected one of the M blocks.

25. The control method according to claim 24, wherein the step a) comprises the step of sequentially selecting one by one from the N groups in a predetermined period divided into N time slots; and the step b) comprises the step of driving at least one selected one of the M blocks in the time slot.

26. The control method according to claim 24, wherein the step b) comprises the step of sequentially selecting one by one from the M blocks in a predetermined period divided into N time slots; and the step a) comprises the step of driving at least one selected one of the N groups in the time slot.

27. The control method according to claim 24, wherein the step c) comprises the step of:

producing a driving pulse to be applied to the selected one of the M blocks;

adjusting the driving pulse depending on which one is selected from the M blocks so as to provide a substantially uniform amount of ejected particulate matter; and applying an adjusted driving pulse to the selected one of the M blocks.

28. The control method according to claim 27, wherein a pulse width of the driving pulse is adjusted.

29. The control method according to claim 27, wherein a voltage of the driving pulse is adjusted.

30. The apparatus according to claim 10, wherein the adjuster adjusts a pulse width and a voltage of the second voltage pulse.

31. The control method according to claim 27, wherein a pulse width and a voltage of the driving pulse are adjusted.

32. The control method according to claim 24, wherein in the step a), each of the N groups is formed by electrically connecting an $i^{th}$ ($1 \leqq i \leqq N$) first electrode for each block to each other.

* * * * *